US012798037B2

(12) United States Patent
Nagengast et al.

(10) Patent No.: US 12,798,037 B2
(45) Date of Patent: Nov. 17, 2026

(54) POLISHING HEAD WITH DECOUPLED MEMBRANE POSITION CONTROL

(71) Applicant: Applied Materials, Inc., Santa Clara, CA (US)

(72) Inventors: Andrew J. Nagengast, Sunnyvale, CA (US); Jeonghoon Oh, Saratoga, CA (US); Kuen-Hsiang Chen, Sunnyvale, CA (US); Steven M. Zuniga, Soquel, CA (US); Takashi Fujikawa, San Jose, CA (US); Jay Gurusamy, Santa Clara, CA (US); Ekaterina A. Mikhaylichenko, San Jose, CA (US); Eric Lau, Santa Clara, CA (US); Huanbo Zhang, San Jose, CA (US); Welarumage Ravin Fernando, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 210 days.

(21) Appl. No.: 18/376,282

(22) Filed: Oct. 3, 2023

(65) Prior Publication Data

US 2025/0108473 A1 Apr. 3, 2025

(51) Int. Cl.
*B24B 37/005* (2012.01)
*B24B 37/04* (2012.01)
(Continued)

(52) U.S. Cl.
CPC ..... *B24B 37/005* (2013.01); *B24B 37/042* (2013.01); *B24B 37/24* (2013.01); *B24B 37/30* (2013.01); *B24B 49/16* (2013.01)

(58) Field of Classification Search
CPC ..... B24B 37/30; B24B 37/32; B24B 37/005; B24B 37/042; B24B 37/105; B24B 49/16; B24B 49/12; B24B 49/08
(Continued)

(56) References Cited

U.S. PATENT DOCUMENTS 5,681,215 A 10/1997 Sherwood et al.
5,865,666 A 2/1999 Nagahara
(Continued)

FOREIGN PATENT DOCUMENTS

CN 106463381 2/2017
CN 108604543 9/2018
(Continued)

OTHER PUBLICATIONS

International Search Report and Written Opinion in International Appln. No. PCT/US2020/047252, dated Nov. 17, 2020, 11 pages.
(Continued)

*Primary Examiner* — Robert F Neibaur
(74) *Attorney, Agent, or Firm* — Fish & Richardson P.C.

(57) ABSTRACT

Chemical mechanical polishing system and method include a substrate is loaded into a carrier head having a housing having an upper carrier body and a lower carrier body, and a membrane assembly beneath the lower carrier body. A space between the lower carrier body and the membrane assembly defines a pressurizable chamber, a distance from a sensor in the lower carrier body to the membrane assembly is measured, and pressure in the pressurizable chamber is controlled based on the measured distances to maintain a consistent total downforce on the membrane assembly as the distance between the sensor and the membrane assembly changes.

14 Claims, 5 Drawing Sheets

(51) Int. Cl.
*B24B 37/24* (2012.01)
*B24B 37/30* (2012.01)
*B24B 49/16* (2006.01)

(58) Field of Classification Search
USPC ..... 451/5, 41, 287, 288, 289, 398
See application file for complete search history.

(56) References Cited

U.S. PATENT DOCUMENTS

| | | | | |
|---|---|---|---|---|
| 6,080,050 | A | 6/2000 | Chen | |
| 6,146,259 | A | 11/2000 | Zuniga et al. | |
| 6,517,415 | B2 | 2/2003 | Govzman et al. | |
| 6,527,625 | B1 | 3/2003 | Kajiwara et al. | |
| 6,663,466 | B2 * | 12/2003 | Chen | B24B 37/30 451/287 |
| 7,207,871 | B1 | 4/2007 | Zuniga et al. | |
| 7,374,644 | B2 | 5/2008 | Butterfield et al. | |
| 9,403,255 | B2 | 8/2016 | Fukushima et al. | |
| 10,946,496 | B2 | 3/2021 | Yavelberg | |
| 11,623,320 | B2 | 4/2023 | Zuniga et al. | |
| 2002/0002025 | A1 | 1/2002 | Chen et al. | |
| 2002/0039879 | A1 | 4/2002 | Zuniga et al. | |
| 2002/0049024 | A1 | 4/2002 | Zuniga et al. | |
| 2002/0086624 | A1 | 7/2002 | Zuniga et al. | |
| 2004/0020788 | A1 | 2/2004 | Mavliev et al. | |
| 2004/0121704 | A1 | 6/2004 | Sakurai et al. | |
| 2005/0221733 | A1 | 10/2005 | Miyashita et al. | |
| 2007/0082589 | A1 * | 4/2007 | Zuniga | B24B 37/30 451/288 |
| 2009/0191797 | A1 | 7/2009 | Nabeya et al. | |
| 2012/0264354 | A1 | 10/2012 | Liao et al. | |
| 2014/0020829 | A1 | 1/2014 | Chen et al. | |
| 2014/0170938 | A1 | 6/2014 | Duescher | |
| 2014/0342640 | A1 | 11/2014 | Fukushima et al. | |
| 2015/0111314 | A1 | 4/2015 | Iizumi et al. | |
| 2018/0056476 | A1 | 3/2018 | Zhang et al. | |
| 2020/0130134 | A1 | 4/2020 | Chen et al. | |
| 2021/0053178 | A1 * | 2/2021 | Zuniga | B24B 37/005 |
| 2021/0053182 | A1 | 2/2021 | Zuniga et al. | |
| 2022/0111484 | A1 | 4/2022 | Nagengast et al. | |
| 2023/0241744 | A1 | 8/2023 | Zuniga et al. | |
| 2024/0082983 | A1 | 3/2024 | Komura et al. | |
| 2024/0213060 | A1 | 6/2024 | Vintila | |
| 2025/0108479 | A1 | 4/2025 | Nagengast et al. | |
| 2025/0235977 | A1 | 7/2025 | Oh et al. | |

FOREIGN PATENT DOCUMENTS

| | | | |
|---|---|---|---|
| CN | 109715342 | | 5/2019 |
| JP | 11-000860 | A | 1/1999 |
| JP | 2002-264005 | | 9/2002 |
| JP | 2005-005661 | A | 1/2005 |
| JP | 2007-019584 | | 1/2007 |
| JP | 2007-053164 | A | 3/2007 |
| JP | 2010141155 | A | 6/2010 |
| JP | 2013-506297 | | 2/2013 |
| JP | 2014-223684 | | 12/2014 |
| KR | 10-2003-0031354 | | 4/2003 |
| KR | 10-2010-0090941 | A | 8/2010 |
| KR | 10-2011-0080937 | | 7/2011 |
| TW | 200942362 | | 10/2009 |
| TW | 202114818 | A | 4/2021 |
| TW | 202116484 | A | 5/2021 |
| TW | 202243804 | A | 11/2022 |
| TW | 202317324 | A | 5/2023 |
| WO | WO 2021035077 | A1 | 2/2021 |
| WO | WO 2022081409 | A1 | 4/2022 |

OTHER PUBLICATIONS

Notice of Allowance in Chinese Appln. No. 202080064418.2, dated Apr. 18, 2024, 8 pages (with English translation).
Office Action in Chinese Appln. No. 202080064418.2, dated Jun. 27, 2023, 14 pages (with English translation).
Office Action in Japanese Appln. No. 2022-509021, dated Feb. 14, 2023, 9 pages (with English translation).
Office Action in Korean Appln. No. 10-2022-7008766, dated Dec. 12, 2023, 13 pages (with English summary).
Office Action in Taiwanese Appln. No. 109128193, dated Feb. 29, 2024, 12 pages (with English summary and search report).
Office Action in Taiwanese Appln. No. 113137279, mailed on Jul. 29, 2025, 54 pages (with English machine translation and search report).
International Search Report and Written Opinion in International Appln. PCT/US2024/048702, mailed on Dec. 31, 2024, 11 pages.

* cited by examiner

POLISHING HEAD WITH DECOUPLED MEMBRANE POSITION CONTROL

TECHNICAL FIELD

This disclosure relates to a carrier head for use in chemical mechanical polishing (CMP).

BACKGROUND

An integrated circuit is typically formed on a substrate by the sequential deposition of conductive, semiconductive, or insulative layers on a semiconductor wafer. A variety of fabrication processes require planarization of a layer on the substrate. For example, one fabrication step involves depositing a filler layer over a non-planar surface and planarizing the filler layer. For certain applications, the filler layer is planarized until the top surface of a patterned layer is exposed. For example, a metal layer can be deposited on a patterned insulative layer to fill the trenches and holes in the insulative layer. After planarization, the remaining portions of the metal in the trenches and holes of the patterned layer form vias, plugs, and lines to provide conductive paths between thin film circuits on the substrate. As another example, a dielectric layer can be deposited over a patterned conductive layer, and then planarized to enable subsequent photolithographic steps.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing slurry with abrasive particles is typically supplied to the surface of the polishing pad.

SUMMARY

In one aspect, a carrier head for chemical mechanical polishing includes a housing for attachment to a drive shaft, a membrane assembly arranged beneath the lower carrier body, and a flexure. The membrane assembly includes a membrane support and a flexible membrane secured to the membrane support to defining a plurality of pressurizable lower chambers, with the flexible membrane having a lower surface that provides a substrate mounting surface. A flexible seal forms a pressurizable upper chamber between the housing and the membrane support. The flexure connects the membrane support to the housing, and the flexure extends through the pressurizable upper chamber.

In another aspect, a chemical mechanical polishing system includes a platen, a carrier head, and a controller. The carrier head includes a housing for attachment to a drive shaft, and the housing includes an upper carrier body and a lower carrier body that is vertically movable relative to the upper carrier body. A first flexible seal forms a first pressurizable chamber between the upper carrier body and the lower carrier body. A membrane assembly is arranged beneath the lower carrier body, the membrane assembly including a membrane support and a flexible membrane secured to the membrane support to define a plurality of pressurizable lower chambers. The flexible membrane has a lower surface that provides a substrate mounting surface. A second flexible seal forms a second pressurizable chamber between the upper carrier body and the lower carrier body. A controller is configured to receive a signal from a sensor arranged to generate data indicative of a pressure in the second pressurizable chamber and is configured to control a pressure source to pressurize the second pressurizable chamber based on the signal.

In another aspect, a method for chemical mechanical polishing includes loading a substrate into a carrier head having a housing having an upper carrier body and a lower carrier body, and a membrane assembly beneath the lower carrier body, wherein a space between the lower carrier body and the membrane assembly defines a pressurizable chamber, measuring a distance from a sensor in the lower carrier body to the membrane assembly, and controlling pressure in the pressurizable chamber based on the measured distances. Controlling pressure in the pressurizable chamber includes maintaining a consistent total downforce on the membrane assembly as the distance between the sensor and the membrane assembly changes.

Advantages may include, but are not limited to, the following. A sensor can detect changes in the distance between a carrier body and the membrane assembly. This change in distance can occur even if chamber pressures are unchanged, e.g., due to wear of a retaining ring. A controller can cause the pressure in a chamber above the membrane assembly to decrease to maintain a consistent load on a substrate across multiple polishing operations, thus improving wafer-to-wafer uniformity. The vertical position of the membrane assembly can be changed without skewing pressure distribution across the membrane.

The details of one or more implementations are set forth in the accompanying drawings and the description below. Other aspects, features, and advantages will be apparent from the description and drawings, and from the claims.

DETAILED DESCRIPTION

In some polishing systems, a membrane in a carrier head is used to apply pressure on a substrate during polishing. For example, a chamber above a membrane assembly can be pressurized to urge the membrane against the substrate. However, as a retaining ring of the carrier head wears, the height of the body that supports the membrane can decrease, and consequently the load on the substrate can increase even if the chamber pressure is not changed, resulting in wafer-to-wafer non-uniformity. For example, as the retaining ring wears, the deflection of a flexure connecting the membrane assembly to the carrier head can increase, resulting in greater down force on the membrane assembly, which in turn can increase the loading on the flexible membrane and the substrate. A potential solution is to adjust a chamber pressure applied to the membrane assembly to compensate for any change in the down force from the flexure so that the total loading on the substrate stays relatively constant. A carrier head having a diaphragm separating the membrane assembly from the lower carrier body which provides the chamber pressure allows independent loading of the membrane assembly from vertical motion of a lower carrier body to which the membrane assembly is connected.

An additional problem, however, is that the actual downforce from the flexure on the membrane assembly is not amenable to direct measurement. However, a distance from the lower carrier body to the membrane assembly can be measured, e.g., by a sensor attached to the lower carrier body. As the measured distance decreases, the pressure in the chamber between the diaphragm and the membrane assembly can be decreased, reducing the change in loading on the substrate and membrane, reducing flex in the membrane sidewalls as the retaining ring wears. This can reduce wafer-to-wafer non-uniformity caused by retaining ring wear or aging of the membrane. The retaining ring and membrane can then have a longer lifespan before requiring replacement.

Figure 1:
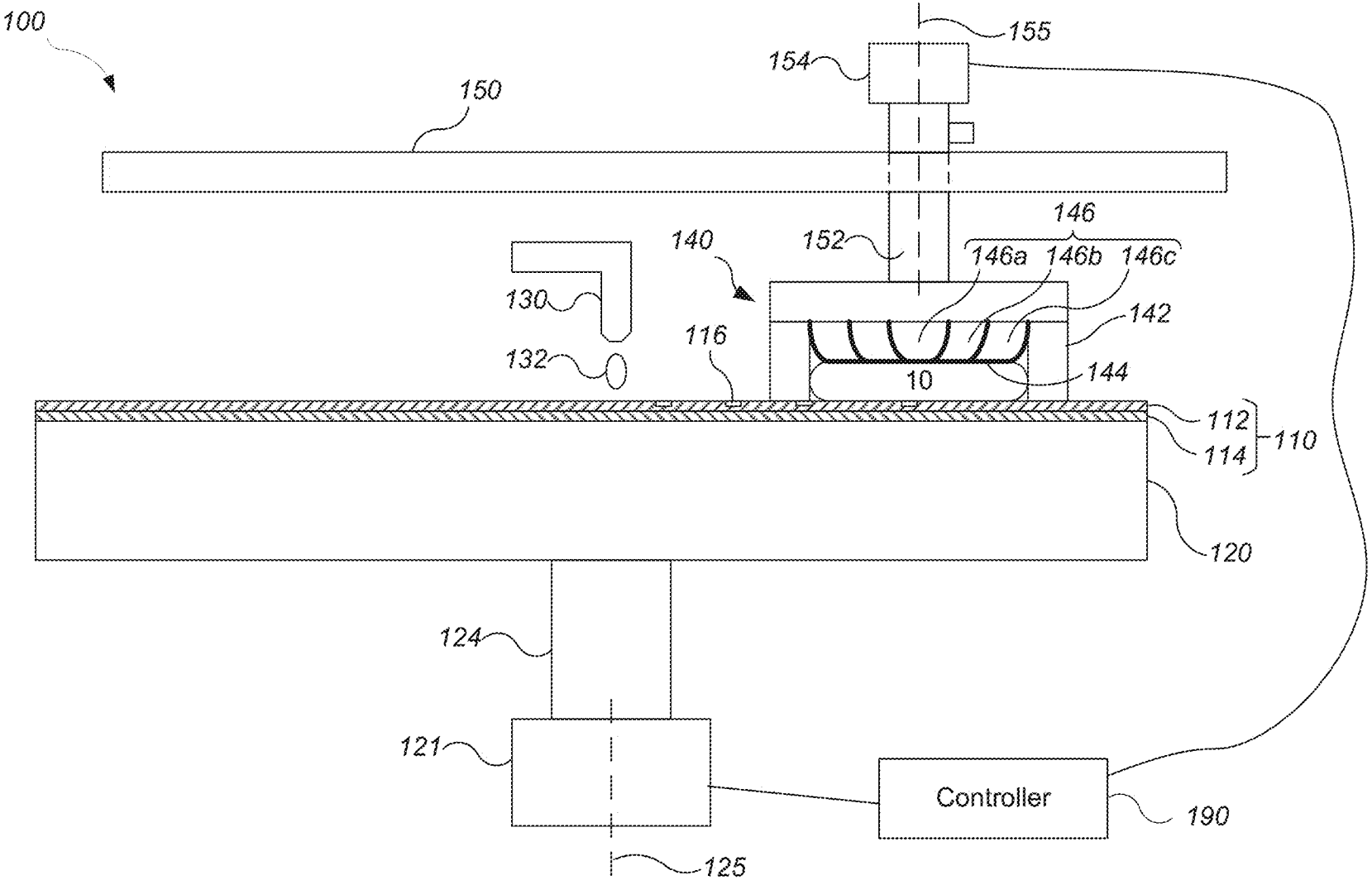
FIG. 1 is a schematic cross-sectional view of an example of a polishing apparatus.

FIG. 1 illustrates an example of a chemical mechanical polishing apparatus 100. The polishing apparatus 100 includes a rotatable disk-shaped platen 120 on which a polishing pad 110 is situated. The platen is operable to rotate about an axis 125. For example, a motor 121, e.g., a DC induction motor, can turn a drive shaft 124 to rotate the platen 120.

The polishing pad 110 can be a two-layer polishing pad with an outer polishing layer 112 and a softer backing layer 114. In some implementations, a plurality of slurry-transport grooves 116 are formed in the top surface of the polishing layer 112 of the polishing pad 110.

The polishing apparatus 100 can include a port 130 to dispense polishing liquid 132, such as abrasive slurry, onto the polishing pad 110. The polishing apparatus can also include a polishing pad conditioner to abrade the polishing pad 110 to maintain the polishing pad 110 in a consistent abrasive state.

The polishing apparatus 100 includes at least one carrier head 140. The carrier head 140 is operable to hold a substrate 10 against the polishing pad 110 such as during a polishing process. The carrier head 140 can control at least the pressure applied to the substrate 10, e.g., the downward pressure on the backside of the substrate which results in an upward pressure of the pad on the front side of the substrate 10.

The carrier head 140 can include a retaining ring 142 to retain the substrate 10 below a flexible membrane 144. The carrier head 140 also includes one or more independently controllable pressurizable lower chambers 146 defined by the membrane 144, e.g., three chambers **146*a*-146*c*, which can apply independently controllable pressures to associated zones on the flexible membrane 144 and thus on the substrate 10. Although only three chambers 146*a*-146*c* are illustrated in FIG. 1** for ease of illustration, there could be one or two chambers, or four or more chambers, e.g., five chambers.

The carrier head 140 is suspended from a support structure 150, e.g., a carousel or track, and is connected by a drive shaft 152 to a carrier head rotation motor 154, e.g., a DC induction motor, so that the carrier head can rotate about an axis 155. Optionally each carrier head 140 can oscillate laterally, e.g., on sliders on the support structure 150, or by rotational oscillation of the carousel itself, or by sliding along the track. In typical operation, the platen is rotated about its central axis 125, and each carrier head is rotated about its central axis 155 and translated laterally across the top surface of the polishing pad.

A controller 190, such as a programmable computer, is connected to the motors 121, 154 to control the rotation rate of the platen 120 and carrier head 140.

Figure 2A:
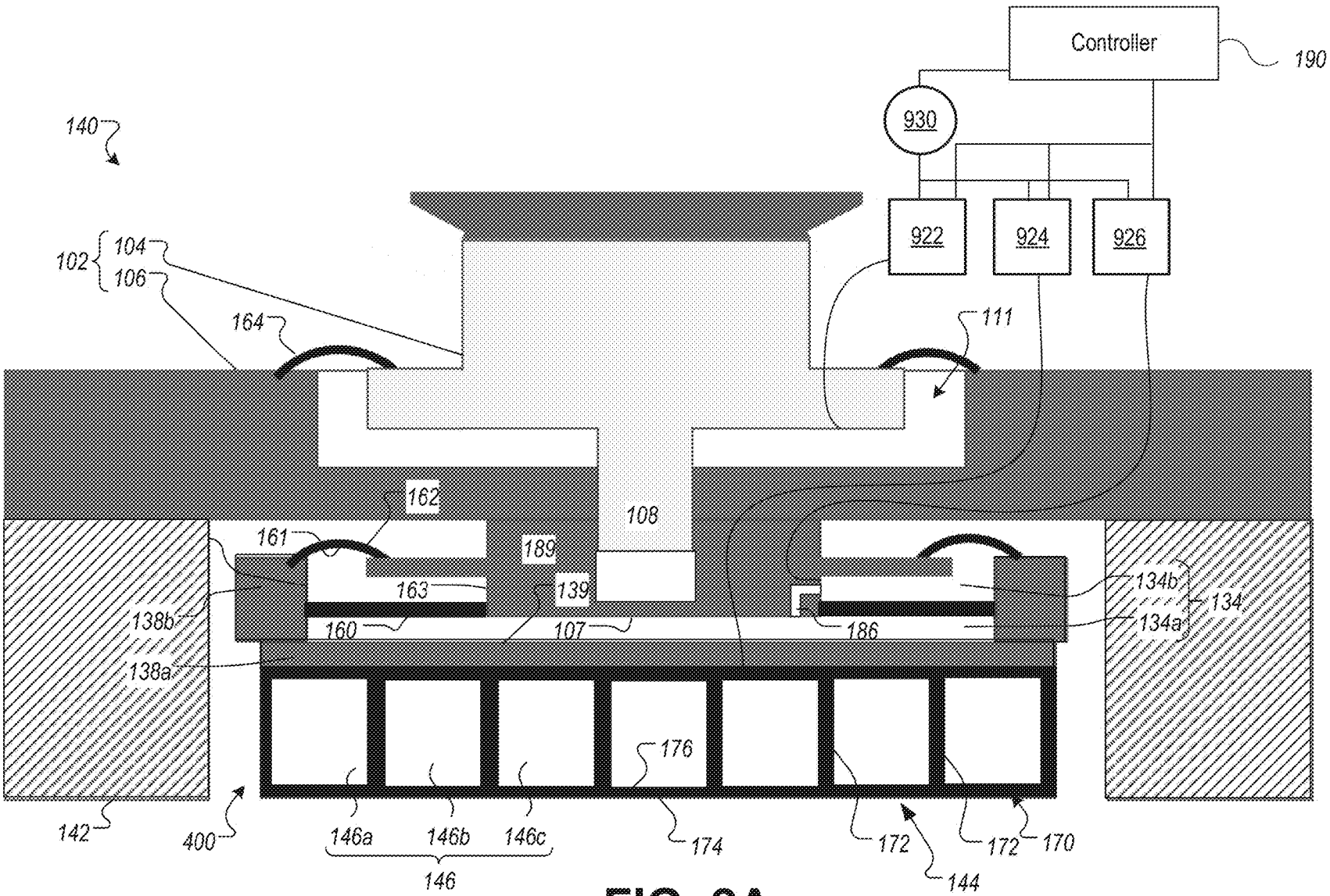
FIG. 2A is a schematic cross-sectional view of a carrier head.

Referring to FIG. 2A, the carrier head 140 includes a housing 102 with an upper carrier body 104 and lower carrier body 106, a gimbal mechanism 108 (which may be considered part of the lower carrier body 106), a retaining ring 142 connected to the housing 102 (e.g., connected the upper carrier body 104 or the lower carrier body 106), and a membrane assembly 400. A volume between the lower carrier body 106 and the upper carrier body 104 can be sealed by an upper flexible seal 164 to provide a loading chamber 111. This upper flexible seal 164 can flex to accommodate the change in vertical position between the upper carrier body 104 and the lower carrier body 106. In some implementations, the upper carrier body 104 and the lower carrier body 106 are replaced by a single unitary body.

The upper carrier body 104 is secured to the drive shaft 152 to rotate the entire carrier head 140. The upper carrier body 104 can generally be circular in shape. There may be passages extending through the upper carrier body 104 for pneumatic control of the carrier head 140. The lower carrier body 106 is located beneath the upper carrier body 104, and vertically movable relative to the upper carrier body 104. The loading chamber 111 is located between the upper carrier body 104 and the lower carrier body 106 to apply a load, e.g., a downward pressure or weight, to the lower carrier body 106. The vertical position of the lower carrier body 106 relative to a polishing pad is also controlled by the loading chamber 111. In some embodiments, the vertical position of the lower carrier body 106 relative to the upper carrier body 104 is controlled by an actuator.

The gimbal mechanism 108 permits the lower carrier body 106 to gimbal and vertically move relative to the upper carrier body 104 while preventing lateral motion of the lower carrier body 106 relative to the upper carrier body 104. However, in some implementations, there is no gimbal.

The substrate 10 is held beneath the carrier head 140 by the retaining ring 142, which retains the substrate 10 against lateral motion. The retaining ring 142 can also provide active edge process control; control of pressure on the polishing pad in a region outside the substrate but adjacent the substrate edge can affect polishing rates at the substrate edge. Some implementations can include an outer ring which can provide positioning or referencing of the carrier head to the surface of the polishing pad.

A volume between the lower carrier body 106 and the membrane assembly 500 can be sealed by a lower flexible seal 162 to form a pressurizable upper chamber 134. This lower flexible seal 162 can flex to accommodate the change in vertical position between the lower carrier body 106 and the membrane assembly 400. Pressure in the pressurizable upper chamber can control the downward load on the membrane assembly 400 and/or the vertical position of the membrane assembly 400 relative to the housing.

Each chamber in the carrier head 140 can be fluidly coupled by passages through the upper carrier body 104 and the lower carrier body 106 to an associated pressure source (e.g., a pressure source 922), such as a pump or pressure or vacuum line. There can be one or more passages for the loading chamber 111, for the pressurizable upper chamber 134, and for each of the individually pressurizable lower chambers 146. One or more passages from the lower carrier body 106 can be linked to passages in the upper carrier body 104 by flexible tubing that extends inside the loading chamber 111 or outside the carrier head 140. Pressurization of each chamber can be independently controlled with respect to other chamber, e.g., pressurization of the chambers can be individually controlled. In particular, pressurization of each lower chamber 146 can be independently controlled. This permits different pressures to be applied to different radial regions of the substrate 10 during polishing, thereby compensating for non-uniform polishing rates.

The membrane assembly 400 can include a membrane support 138 and the flexible membrane 144. The flexible membrane 144 has a circular lower portion 170 having a lower outer surface 174 that provides a mounting surface for the substrate 10. The flexible membrane 144 also has a plurality of flaps 172, e.g., annular flaps, which extend from the inner surface 176 of the lower portion 170 to define the individually controllable pressurizable lower chambers 146. For example, the ends of the flaps 172, e.g., the ends adjacent the lower portion 138*a*, can be clamped to the membrane support 138.

The membrane support 138 can include a disk-shaped lower portion 138*a* and an annular upper portion 138*b* that extends upwardly from the disk-shaped lower portion 138*a* at an outer edge thereof. The flaps 172 of the flexible membrane 144 can be clamped to the disk-shaped lower portion 138*a*. The membrane support 138 can be formed of a material that is more rigid than the membrane 144, e.g., a metal, ceramic, or hard plastic. The membrane support 138 can be considered inflexible under the pressure regimes typically occurring the polishing process.

The pressurizable upper chamber 134 is configured to extend across the top of the membrane support 138 and be contained by the lower flexible seal 162. In particular, the pressurizable upper chamber 134 can be bounded on the bottom by the top surface 139 of the disk-shaped lower-portion 138*a*, on the sides by the inner surface 141 of the annular upper portion 138*b*, and on the top by the bottom surface 161 of the lower flexible seal 162, and the bottom surface 107 of the lower carrier body 106.

Still referring to FIG. 2A, the lower carrier body 106 can be connected to the membrane assembly 400 by a flexure 160. The flexure 160 is more rigid than the lower flexible seal 162, but less rigid than the membrane support 138. The membrane assembly 400 is suspended from the lower carrier body 106 by the flexure 160. In addition, the flexure 160 acts as a spring, urging the membrane assembly 400 toward a "neutral" position while still permitting the membrane assembly 400 to move vertically relative to the housing 102 based on the pressure in the pressurizable upper chamber 134. The flexure 160 can be connected to the lower carrier body 106 and the membrane assembly 400 using fasteners, e.g., adhesive, screw, bolt, clamp, or by interlocking, to name a few examples.

The flexure 160 extends through the pressurizable upper chamber 134 between the inner surface 141 of the upper portion 138*b* of the membrane assembly 400 and a sidewall 163 of a downward projection 189 of the lower carrier body 106. The projection 189 extends downward toward the upper surface 139 of the lower portion 138*a* of the membrane support 138.

Figure 4:
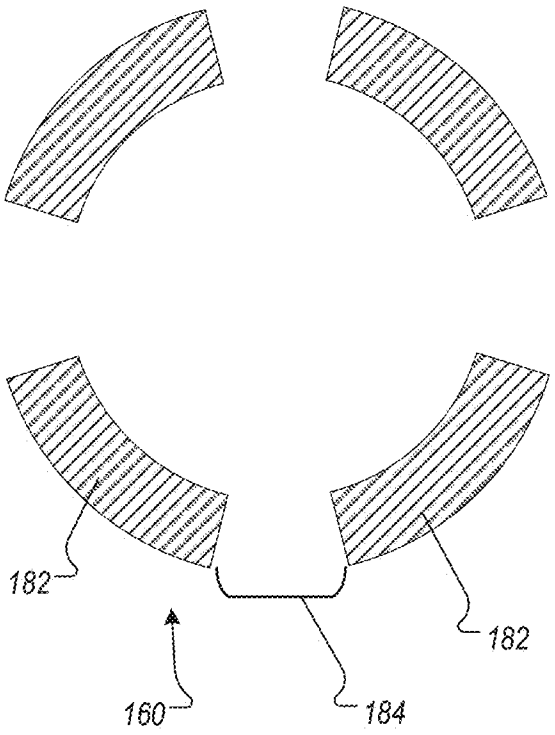
FIG. 4. is a schematic top view of another implementation of the flexure.
Figure 3:
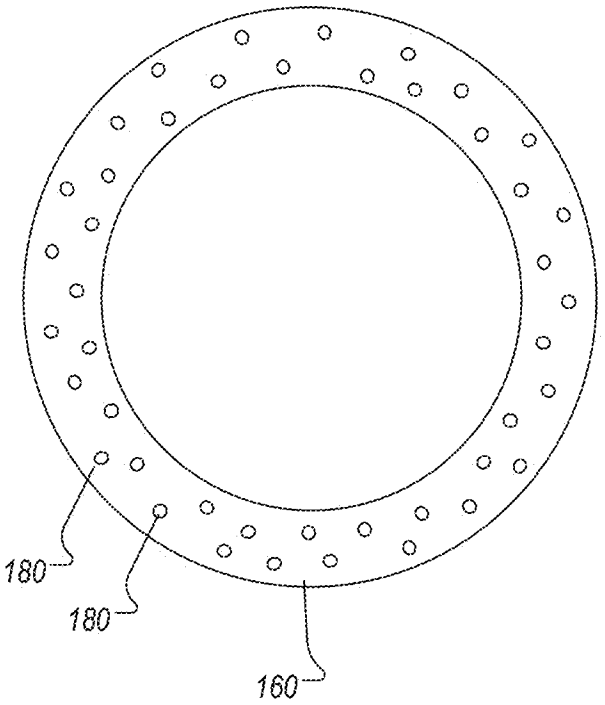
FIG. 3 is a schematic top view of a flexure from a carrier head.

Thus, the pressurizable upper chamber 134 can include a lower portion 134*a* below the flexure 160, and an upper portion 134*b* above the flexure 160. The lower portion 134*a* and upper portion 134*b* are fluidically coupled to stay at the same pressure. In some implementations, the flexure 160 has gaps or apertures to permit the flow of gas. For example, referring to FIG. 3, the flexure 160 can be an annular body that includes multiple apertures 180 therethrough. As another example, referring to FIG. 4, the flexure 160 can be provide by multiple arcuate pieces 182 that are separated by gaps 184. In some implementations, the lower portion 134*a* and the upper portion 134*b* are connected by a passage 186 through the housing 102, e.g., through the lower carrier body 106. In this case, the flexure 160 can be an annular body that is fluid impermeable, e.g., a solid unitary body without apertures 180 or gaps 184.

The upper flexible seal 164 and the lower flexible seal 162 can be composed of a flexible material such as a rubber, e.g., silicone rubber, ethylene propylene diene terpolymer (EPDM), or a fluoroelestomer, or a plastic film, e.g., polyethylene terephthalate (PET) or polyoxymethylene.

The flexure 160 is sufficiently stiff to resist lateral motion so as to keep the membrane assembly 400 centered below the lower carrier body 106. However, the flexure 160 can be sufficiently vertically flexible to permit vertical motion of the membrane assembly 400 relative to the housing 102. The flexure 160 permits the assembly 400 to vertically move relative to the lower carrier body 106 by flexing, e.g., bendably deflecting. An advantage of the configuration with the flexure 160 extending through the upper chamber 134 is that the pressure in the pressurizable upper chamber 134 can be adjusted without inducing pressure differentials across the flexure 160, thus avoiding reacting out pressure through the flexure, which can skew pressure distribution across the membrane 144, e.g., against the substrate 10. An advantage of pressure on both sides of the flexure 160 is to reduce stresses would be created by bending of the flexure 160 by applying pressure on only one side.

The controller 190 regulates the pressure of the various chambers of the carrier head 140. The controller 190 is coupled to a plurality of pressure sources, e.g., pressure source 922, pressure source 924, and pressure source 926. The pressure sources 922, 924, 926 can be, for example, a pump, a facilities gas line and controllable valve, etc. Each of the pressure sources 922, 924, 926 can be individually connected to a pressurizable chamber. In the example of FIG. 2A, pressure source 922 connects to loading chamber 111, pressure source 924 is connected to the pressurizable lower chambers 146, and pressure source 926 is connected to the pressurizable upper chamber 134. Although only one pressure source 924 is shown for ease of illustration, there can be one per lower chamber 146 so that each lower chamber 146*a*-146*c* can be individually controlled.

One or more sensors 930 measure the pressure(s) applied by the pressure sources 922, 924, 926, e.g., the pressures in the individually pressurizable lower chambers 146, the pressurizable upper chamber 134, and the loading chamber 111. The sensor 930 communicates the measured pressure(s) to the controller 190. The controller 190 causes the pressure sources 922, 924, 926 to increase and/or decrease the pressure in the pressurizable lower chambers 146, the pressurizable upper chamber 134, and/or the loading chamber 111.

As the carrier head 140 performs polishing operations, the retaining ring 142 wears down. As the retaining ring 142 wears down, the flexure 160 flexes to apply an increased downward pressure on the membrane support 138, and thus the substrate 10, resulting in an increased polishing rate of the substrate 10. To compensate for wear of the retaining ring 142 resulting in increased load (e.g., applied pressure) on the substrate 10, the pressure in the pressurizable upper chamber 134 can be adjusted, e.g., decreased, to maintain a consistent total load on the substrate 10.

The increased downward pressure from retaining ring 142 wear can also cause wear on the membrane 144 as the lower seal 162 flexes and increases pressure on the membrane assembly 400. The increased pressure can cause bowing or flexing of one or more walls of the lower chambers 146 which increases wear on the membrane 144.

Figure 2B:
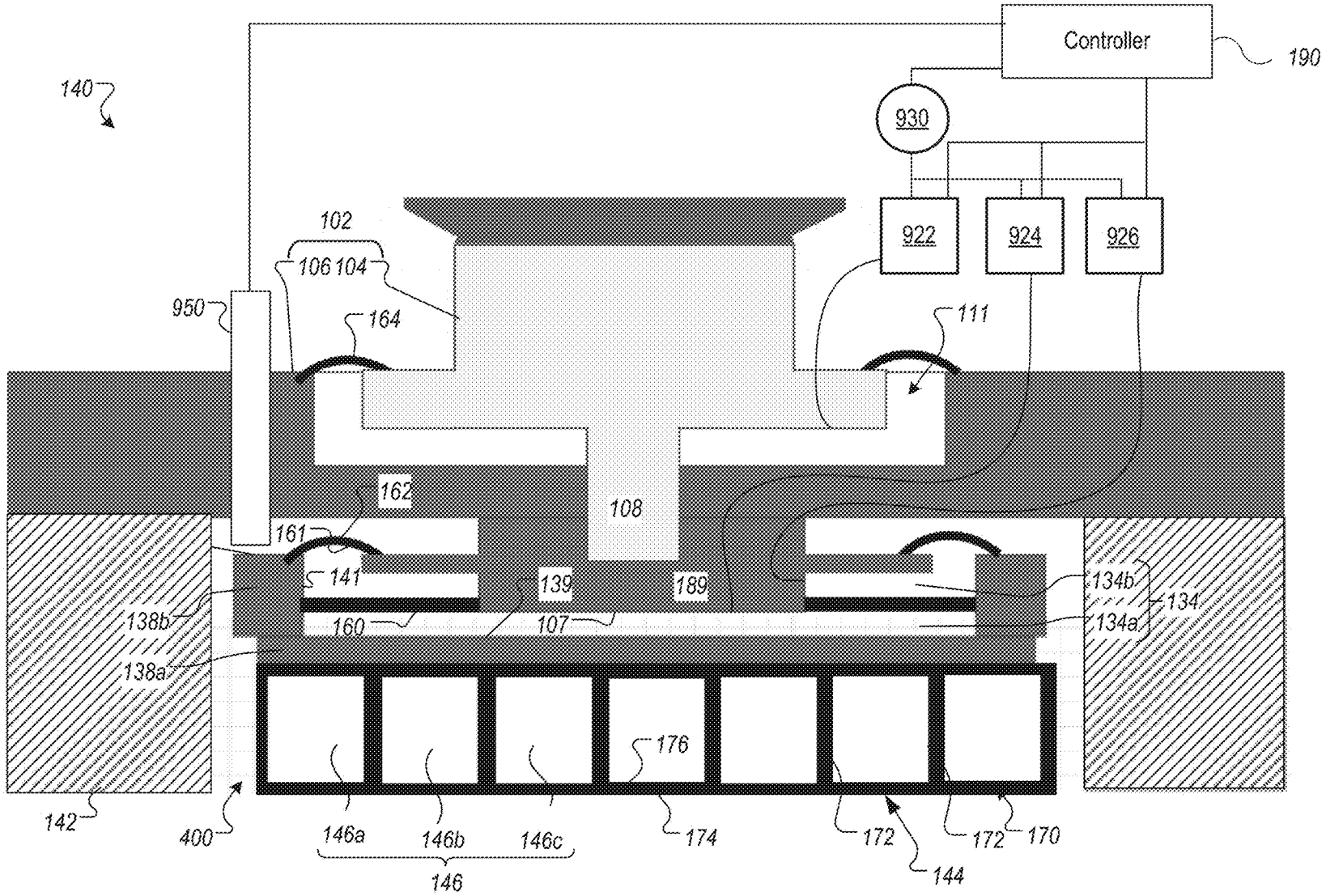
FIG. 2B is a schematic cross-sectional view of another implementation of a carrier head.

Referring to FIG. 2B, to determine the requisite change in pressure, a sensor 950 can measure the distance or a change in distance from the sensor 950 to the membrane assembly 400, and the controller 190 can detect the change in the distance based on the signal from the sensor 950. The sensor 950 can be a magnetic (e.g., eddy current), radar, laser, optical, ultrasonic, or other similar proximity sensor.

The sensor 950 can be secured in the carrier head 140, e.g., secured to the lower carrier body 106. The sensor 950 is positioned to measure a distance between the sensor 950 and a target. For example, the target can be a portion of the top surface of the membrane assembly 400 (e.g., the top surface of the membrane support 138, e.g., the top surface of the annular upper portion 138*b* of the membrane support 138) below the sensor 950. As such, the sensor 950 can measure a distance between the lower carrier body 106 and the membrane support 138 of the membrane assembly 400.

The pressurizable upper chamber 134 can be pressurized or vented to atmosphere to permit the membrane assembly 400 to rest on the polishing pad before performing the measurement of the distance with the sensor 950. This can ensure that the bottom of the membrane assembly 400 is aligned to the bottom surface of the retaining ring 142.

Further, the sensor 950 is connected to the controller 190, and reports the measured distance or change in measured distance (e.g., a decreased distance due to wear of the retaining ring 142) to the controller 190. The controller 190 can in turn cause the pressure source 926 to decrease the pressure in the pressurizable upper chamber 134 to maintain the load on the substrate 10.

The controller 190 can be configured to adjust the pressure of the pressurizable upper chamber 134 based on the measured distance between the sensor 950 and the target. That is, the controller 190 can be configured such that, as the flexure 160 flexes and decreases the distance between the sensor 950 and the target, thereby increasing the pressure applied by the flexure 160 to the substrate 10, the controller 190 decreases the pressure of the pressurizable upper chamber 134 to compensate for the increased pressure applied by the flexure 160.

The pressure of the pressurizable upper chamber 134 can be a function of the measured distance between the sensor 950 and the target, e.g., surface 402. For example, as the measured distance between the sensor 950 and the target decreases, the pressure of the pressurizable upper chamber 134 can decrease. The controller 190 can receive the intended pressure, e.g., from a polishing recipe represented by data stored in a non-transitory computer readable medium, and the measurement of the distance from the sensor 950. The controller 190 calculates a revised pressure for the pressurizable upper chamber 134 based on intended pressure and the distance measurement. The amount to decrease the pressure in the pressurizable upper chamber 134 can be stored in a look-up table that correlates the change in pressure to the distance. The change in pressure can be a non-linear function of the distance and can depend on the flexure 160 design. In addition, the change in pressure can be stored in the look-up table as an absolute pressure change or a percentage change relative to the intended pressure. This change is applied, e.g., by subtraction or multiplication as necessary based on the type of change, to the intended pressure to calculate the revised pressure.

To determine the functional relationship between the distance and the pressure difference, a sequence of paired measurements of i) distance and ii) total down pressure from the membrane assembly 400 can be made using retaining rings 142 with different amounts of wear, e.g., a new retaining ring and a used retaining ring. In particular, the retaining ring 142 can be installed on the carrier head 140, the carrier head 140 positioned over a pressure sensor, e.g., a pressure sensor pad, and the pressurizable upper chamber 134 brought to a consistent pressure for each pair of measurements.

The distance is measured by the sensor 950, and the total applied pressure from the membrane assembly 400 is measured by another sensor, e.g., the pressure sensor pad. The plurality of paired measurements provide the increase in applied pressure as a function of the distance measurement. A pressure offset for the pressurizable upper chamber 134 to bring the total applied pressure back to a consistent pressure value can be calculated as a function of the measured distance from the paired measurements.

Figure 5:
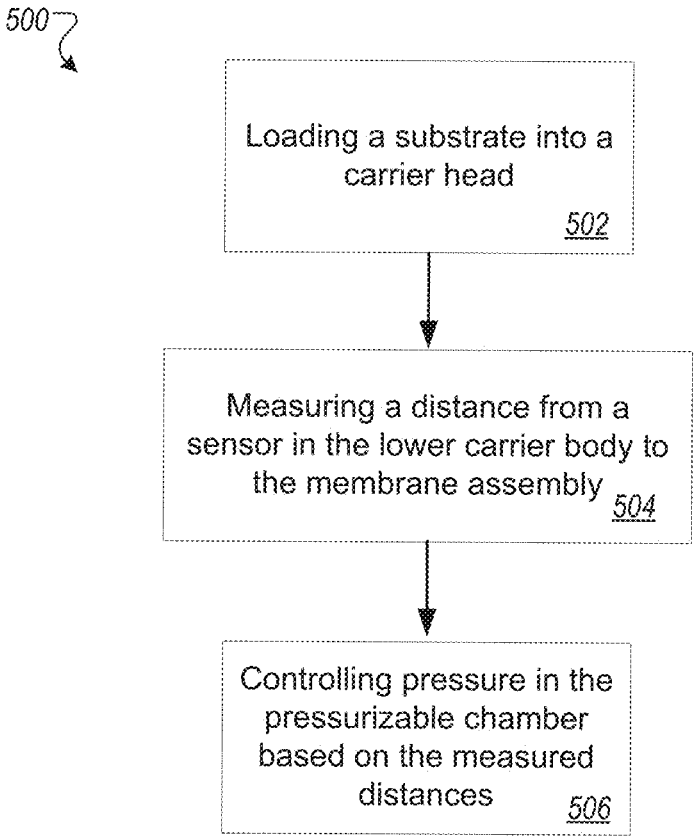
FIG. 5 is a flow chart diagram depicting a method of chemical mechanical polishing for controlling pressure in one or more pressurizable chambers.

FIG. 5 is a flow chart diagram depicting a method 500 of controlling pressure in one or more pressurizable chambers. The method 500 can be used to control any of the apparatuses and systems disclosed herein, such as apparatus 100. The method 500 includes loading a substrate into a carrier head (step 502). The carrier head can have a housing having an upper carrier body and a lower carrier body, and a membrane assembly beneath the lower carrier body. The lower carrier body and the membrane assembly can be connected by a flexure, and a space between the lower carrier body and the membrane assembly defines a pressurizable chamber. The pressurizable chamber is connected to a pressure source and one or more pressure sensors, the pressure sensor can measure the pressure within the chamber and a controller can regulate the pressure source to increase, decrease, or maintain the pressure within the chamber based on the readings from the sensor.

The housing includes a sensor for measuring a distance between the housing, e.g., the lower carrier body, and the membrane assembly. The method 500 includes measuring a distance from the sensor in the lower carrier body to the membrane assembly (step 504). The distance between the lower carrier body and the membrane assembly is at least in part related to the pressure within the pressurizable chamber.

The method 500 includes controlling a pressure in the pressurizable chamber based on the measured distances (step 506). Controlling the pressure in the lower pressurizable chamber includes maintaining a consistent total downforce on the membrane assembly as the distance between the sensor and the membrane assembly changes, such as when the retaining ring wears or when the membrane flexes. Step 506 can include decreasing pressure in the lower pressurizable chambers as the measured distances decreases. In an example, step 506 can include controlling pressure in the pressurizable chamber which includes compensating for changes in load on the membrane assembly based on wear of a retaining ring.

The controller and other computing devices part of systems described herein can be implemented in digital electronic circuitry, or in computer software, firmware, or hardware. For example, the controller can include a processor to execute a computer program as stored in a computer program product, e.g., in a non-transitory machine-readable storage medium. Such a computer program (also known as a program, software, software application, or code) can be written in any form of programming language, including compiled or interpreted languages, and it can be deployed in any form, including as a standalone program or as a module, component, subroutine, or other unit suitable for use in a computing environment.

In context of the controller, "configured" indicates that the controller has the necessary hardware, firmware or software or combination to perform the desired function when in operation (as opposed to simply being programmable to perform the desire function).

While this document contains many specific implementation details, these should not be construed as limitations on the scope of any inventions or of what may be claimed, but rather as descriptions of features specific to particular embodiments of particular inventions. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

A number of embodiments of the invention have been described. Nevertheless, it will be understood that various modifications may be made without departing from the spirit and scope of the invention. Accordingly, other implementations are within the scope of the following claims.

What is claimed is:

1. A chemical mechanical polishing system, comprising:
a platen;
a carrier head including
a housing for attachment to a drive shaft, wherein the housing includes an upper carrier body and a lower carrier body that is vertically movable relative to the upper carrier body,
a first flexible seal forming a first pressurizable chamber between the upper carrier body and the lower carrier body,
a membrane assembly arranged beneath the lower carrier body, the membrane assembly including a membrane support and a flexible membrane secured to the membrane support to define a plurality of pressurizable lower chambers, the flexible membrane having a lower surface that provides a substrate mounting surface,
a second flexible seal forming a second pressurizable chamber between the the lower carrier body and the membrane support, and
a sensor attached to the carrier head and positioned to generate a signal based on a distance between the lower carrier body and the membrane support and across a gap located outside the second pressurizable chamber; and
a controller configured to receive the signal from the sensor and to generate data indicative of a pressure in the second pressurizable chamber and configured to control a pressure source to pressurize the second pressurizable chamber based on the signal.

2. The system of claim 1, wherein the sensor is mounted on the lower carrier body.

3. The system of claim 1, wherein the sensor is an eddy current sensor, a radar sensor, a laser sensor, or an ultrasonic sensor.

4. The system of claim 1, wherein the controller is configured to reduce pressure in the pressurizable chamber to offset increased pressure by the second flexible seal.

5. The system of claim 1, further comprising a retaining ring connected to the lower carrier body, wherein wear on the retaining ring causes the distance to decrease.

6. The system of claim 1, wherein the controller is configured to cause the second pressurizable chamber to be vented to atmosphere to permit the membrane assembly to rest on a polishing pad on the platen for generation of the signal from the sensor.

7. The system of claim 1, wherein the controller is configured to cause the second pressurizable chamber to be pressurized to press the membrane assembly onto a polishing pad on the platen for generation of the signal from the sensor.

8. The system of claim 1, wherein the membrane support comprises a lower portion to which the flexible membrane is secured and an annular upper portion extending upward from the lower portion, wherein the first pressurizable chamber is located radially inward of the annular upper portion.

9. The system of claim 8, wherein a first portion of the lower carrier body extends over the annular upper portion of the membrane support, and the sensor is configured to generate a signal based on a distance between a bottom surface of the first portion of the lower carrier body and a top surface of the annular upper portion.

10. The system of claim 9, wherein a second portion of the lower carrier body extends downwardly into an aperture in the annular upper portion and the first flexible seal extends inwardly from the annular upper portion to the second portion of the lower carrier body.

11. A chemical mechanical polishing system, comprising:
a platen;
a carrier head including
a housing for attachment to a drive shaft, wherein the housing includes an upper carrier body and a lower carrier body that is vertically movable relative to the upper carrier body,
a first flexible seal forming a first pressurizable chamber between the upper carrier body and the lower carrier body,
a membrane assembly arranged beneath the lower carrier body, the membrane assembly including a membrane support and a flexible membrane secured to the membrane support to define a plurality of pressurizable lower chambers, the flexible membrane having a lower surface that provides a substrate mounting surface, and
a second flexible seal forming a second pressurizable chamber between the lower carrier body and the membrane support;
a flexure connecting the membrane support to the lower carrier body, the flexure extending through the second pressurizable chamber; and
a controller configured to receive a signal from a sensor arranged to generate data indicative of a pressure in the second pressurizable chamber and configured to control a pressure source to pressurize the second pressurizable chamber based on the signal.

12. The system of claim 11, wherein a first portion of the second pressurizable chamber above the flexure is fluidically connected to a second portion of the second pressurizable chamber below the flexure.

13. The system of claim 12, wherein the flexure is sufficiently stiff to horizontally center the membrane assembly within the housing.

14. The system of claim 12, wherein the flexure is sufficiently stiff to vertically center the membrane assembly within the housing.

* * * * *